United States Patent [19]

St. Cyer

[11] Patent Number: 5,052,840

[45] Date of Patent: Oct. 1, 1991

[54] MOP USEFUL IN THE CLEANING OF TUBS

[75] Inventor: Barbara A. St. Cyer, Kelowna, Canada

[73] Assignees: Ilona Enevoldson, Kelwona; Morris Allan Shoaf, Burnaby; Merlene Hoffman, Red Deer, all of Canada

[21] Appl. No.: 427,533

[22] Filed: Oct. 26, 1989

Related U.S. Application Data

[63] Continuation-in-part of Ser. No. 36,835, Apr. 10, 1987, abandoned.

[30] Foreign Application Priority Data

May 1, 1986 [CA] Canada ..... 508124

[51] Int. Cl.[5] ..... A47K 7/02; B43K 8/10

[52] U.S. Cl. ..... 401/201; 15/244.1; 401/140; 401/207

[58] Field of Search ..... 401/140, 203-207, 401/196, 201; 15/244.1, 244.2

[56] References Cited

U.S. PATENT DOCUMENTS

| | | | |
|---|---|---|---|
| 663,248 | 12/1900 | Sturgis | 401/207 |
| 1,100,367 | 6/1914 | Gambill | 15/244.1 |
| 1,186,088 | 6/1916 | Finlay | 401/207 |
| 1,221,218 | 4/1917 | Reid | 401/205 X |
| 1,714,350 | 5/1929 | DeJong | 401/205 |
| 1,715,907 | 6/1929 | Dragelin | 401/203 X |
| 1,773,894 | 8/1930 | Tripp | 401/205 X |
| 1,936,131 | 11/1933 | Hefft | 401/207 X |
| 2,225,101 | 12/1940 | Conk et al. | 15/244.1 X |
| 2,310,006 | 2/1943 | Wisner | 401/206 X |
| 2,537,784 | 1/1951 | Nord | 401/205 |
| 2,647,273 | 8/1953 | Eagle | 401/207 X |
| 2,805,435 | 9/1957 | Boscarino | 401/205 |
| 2,839,770 | 6/1958 | Boscarino | 401/206 |
| 2,887,706 | 5/1959 | Griffeth et al. | 401/207 X |
| 3,074,100 | 1/1963 | Sherbondy | 401/205 |
| 3,127,631 | 4/1964 | Hershberger et al. | 401/206 X |
| 3,161,905 | 12/1964 | Dryden | 401/204 |
| 3,395,418 | 8/1968 | Malmo | 15/244.1 X |
| 3,720,976 | 3/1973 | Bailey | 15/244.2 |
| 3,932,043 | 1/1976 | Joffre | 401/205 X |

*Primary Examiner*—Danton D. DeMille
*Attorney, Agent, or Firm*—Townsend and Townsend

[57] ABSTRACT

A support member has a hollow body, is open at its top, and has ends, sides and a base. It includes openings in the base of the support member. A socket on the base receives a handle and a compressible, absorbent sponge is anchored to the support member. The sponge has a top surface, flat ends, and upright slits which extend from the top surface into the sponge to define a plurality of adjacent sponge flaps. The flaps are compressed into firm frictional engagement by a locking member that is received within the support member.

10 Claims, 3 Drawing Sheets

MOP USEFUL IN THE CLEANING OF TUBS

CROSS-REFERENCE TO RELATED APPLICATION

This application is a continuation-in-part of Application Ser. No. 07/036,835, filed Apr. 10, 1987, the subject matter of which is incorporated herein by reference.

FIELD OF THE INVENTION

This invention relates to a mop, particularly a mop useful in the cleaning of tubs.

DESCRIPTION OF THE PRIOR ART

Typically, in cleaning a tub, a cleaner is either applied to a hand-sponge or the tub and the person doing the cleaning then kneels by the tub and moves the sponge, with the cleaner, over the surface of the tub. Such work can be hard, especially for anyone with back problems, for the elderly or invalid. A number of suggestions have been made to provide improved sponges but still the most common way of cleaning a tub is the traditional way outlined above.

The specific prior art known to applicant includes U.S. Pat. Nos. 3,214,779 to Wheeler; 3,090,985 to Baum; 3,039,126 to Kessler; 2,983,944 to Uselis; 2,733,467 to Garro; 4,099,289 to Bretthauer; 3,875,609 to Wells; 3,274,635 to Myers; 3,161,905 to Pryden; 2,880,443 to Le Febvre; and 929,860 to Keith and U.S. Pat. No. 159,243 to Atwood.

However it is believed that all of the above prior art has the disadvantage of relative complexity and less than ideal use. The two most pertinent patents are those to Wheeler and Baum. Of these Wheeler has a universal adjustment joint that comprises a relatively large number of parts. Similarly the Baum mop is of relative complexity and also has the disadvantage of a relatively thin sponge.

In applicant's Canadian patent 1,224,005, applicant provided a mop that overcomes many of the disadvantages of the prior art.

SUMMARY OF THE INVENTION

The present invention comprises a modified version of the above mop that can be used, particularly in cleaning a tub, by one person standing at one position. That is, it is not even necessary for the person doing the cleaning to move his or her position by the side of the tub. Furthermore the construction is such that there is no prospect of scratching and the large volume of the sponge and the ease with which it can conform to the inner contours of the tub is an advantage. The mop of the present invention is also extremely simple in structure.

The present invention provides a mop comprising a support member comprising a hollow body, open at its top, and having ends, sides and a base; openings in the base of the support member; a socket attached to the base to receive a handle; a compressible, absorbent sponge anchored to the support member and comprising a body having a top and flat ends; a recess in the top of the body to receive the support member, the body curving longitudinally outwardly to its middle from each end and having a convex base.

The present invention also provides a mop comprising a support member comprising a hollow body, open at its top, and having ends, sides and a base, a clamping member comprising a hollow body having an open base and having ends, sides and a top, and being dimensioned to fit within the support member with a predetermined peripheral clearance between the two members, a socket attached to the exterior of the top of the locking member to receive a handle, a compressible, absorbent sponge comprising a body having a top and flat ends with a recess formed in the top, whereby the support member may be located in the recess in the sponge and the clamping member pressed into the support member to compress the sponge between the exterior of the clamping member and the interior of the support member to locate the sponge.

DRAWINGS

Embodiments of the invention are illustrated in the accompanying drawings, in which.

Throughout the drawings like reference numerals denote like parts.

DESCRIPTION OF THE PREFERRED EMBODIMENTS

Figure 1:
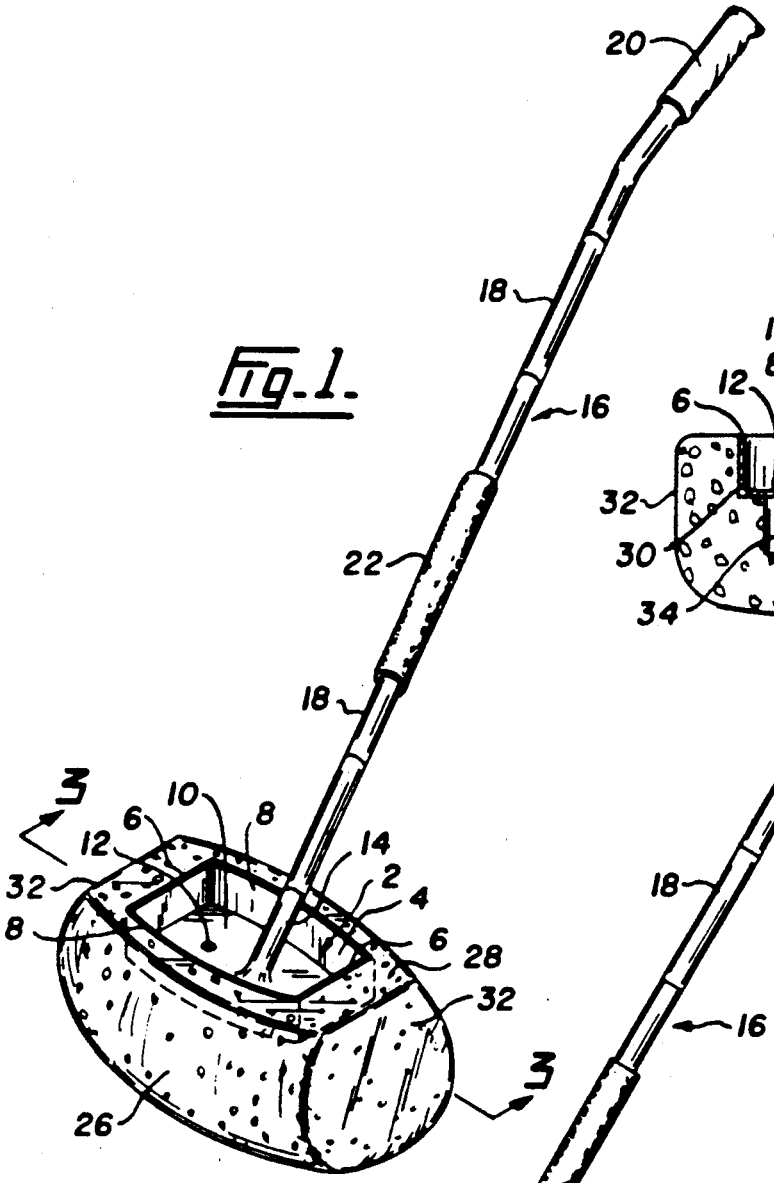
FIG. 1 is a general view of a mop according to the present invention.

The drawings show a mop comprising a support member 2 that is a hollow body, open at its top 4 and having ends 6, sides 8 and a base 10. There are openings 12 in the base 10 of the support member 2. A socket 14 extends from the support member 2 to receive a handle 16. That handle, in the illustrated preferred embodiments, comprises a plurality of sections 18, each about a foot in length, each able to attach to a neighbouring section. At its top the handle 16 is curved and formed with a grip 20. The handle also includes a bumper or buffer 22, movable along the handle 16, to contact the uppermost sides of a tub and thus prevent scratching of the bath when the mop is in use. Preferably the socket is inclined at an angle of about 20° to 23° to the base 10 and the handle 20 is at an angle of about 45° at its top.

There is a compressible, absorbent sponge 26 adhered to the support 2. Any known, water-proof adhesive may be used.

Sponge 26 has a flat top 28, with a recess 30 to receive the support member 2 and flat ends 32. The body curves longitudinally outwardly to its middle from each end 32 and has a convex front, rear and base. As shown Particularly in FIG. 3 there are openings 34 formed in the sponge, aligned with the openings 12 in the support member 2 so that a liquid cleaner may be placed in the support member 2 and from there percolate to the sponge 26. Recess 30 can also be a longitudinal slit communicating with two transverse internal slits to receive support member 2.

The mop is constructed simply by placing the sponge 26 over the support member 2; relatively slight distortion of the sponge is sufficient to obtain the necessary position. An adhesive may be applied to the support member 2 prior to placing the sponge 26 over it. Alternatively if the arrangement of slits is used as described above the sponge 26 may simply be held in place by friction. The lengths 18 of handle 16 are used depending on the height of the person using the sponge. The mop is then ready to use. Typically a detergent will be placed in the support member 2 and allowed to percolate into the sponge 26. The sponge 26 may then be moved around the tub for cleaning. Because of its shape and because of the large volume of the sponge 26 the sponge can easily conform to the shapes various parts of the tub. Furthermore because of the handle the tub can be cleaned by one person standing at one place.

To clean the mop after use it is simply pressed against the tub and the water is expressed in conventional manner.

Figure 3:
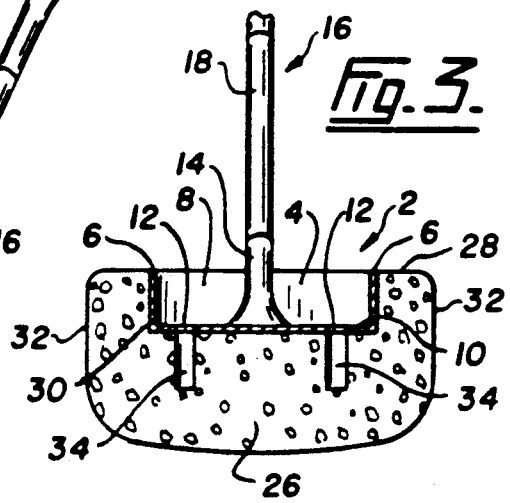
FIG. 3 is a section on line 3—3 in FIG. 1.
Figure 2:
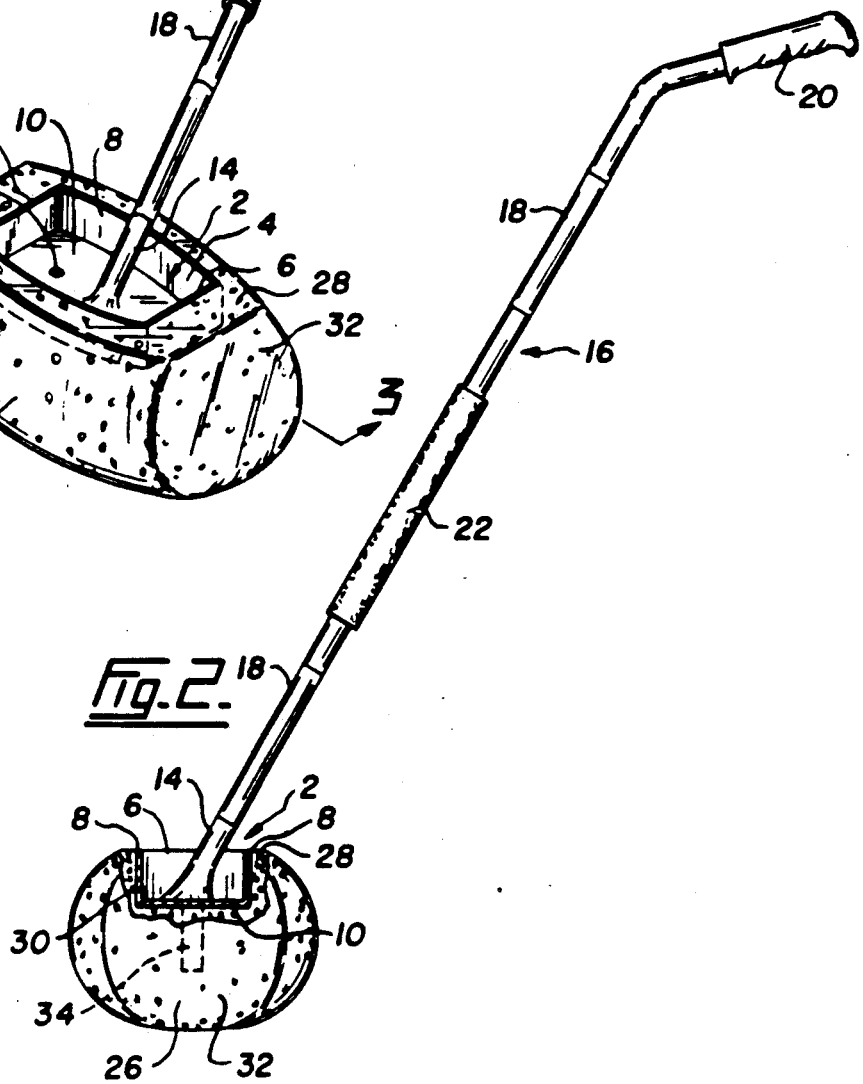
FIG. 2 is a side elevation, partially in section, of the mop of the present invention.
Figure 4:
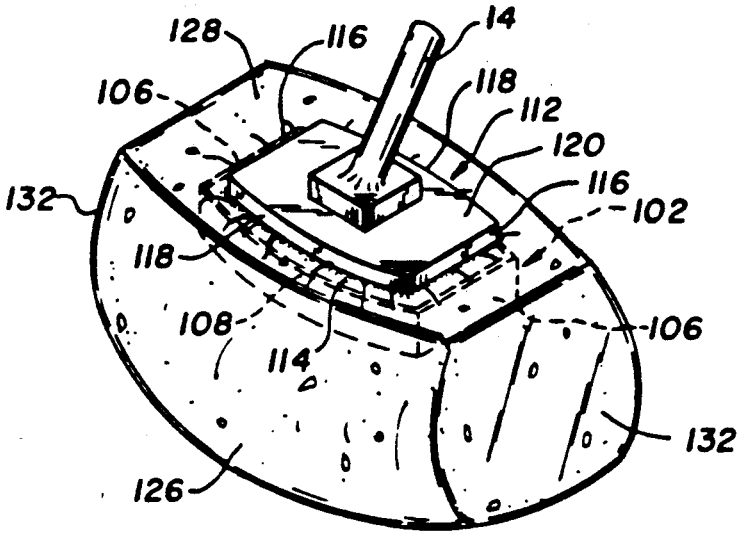
FIG. 4 is a general view of a further embodiment of the present invention.
Figure 5:
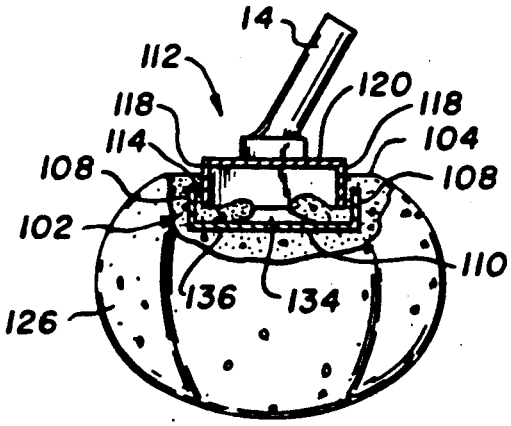
FIG. 5 is an end elevation, partially in section, of the mop in FIG. 4.

FIGS. 4 and 5 show a further embodiment of the invention. That embodiment has a support member 102 comprising a hollow body, open at its top 104 and having ends 106, sides 108 and a base 110. There is a locking member 112 comprising a hollow body having an open base 114 and having ends 116, sides 118 and a top 120. The locking member 112 is dimensioned to fit within the support member 102 with a predetermined clearance 114 at the periphery, as shown in FIG. 5. As in the embodiment of FIGS. 1 to 3 there is a socket 14, but here attached to the exterior of the base 120 of the locking member 112. As in the previous embodiment the socket receives a handle, extending away from the base 120. The handle is shown in FIGS. 1 to 3 is appropriate. Although not shown the protective buffer 22 may also be used with the handle.

There is a compressible, absorbent sponge 126, which may be precisely the same composition as sponge 26 of FIGS. 1 to 3. Sponge 126 has a top 128 and flat ends 132. There is a longitudinal slit 134 formed in the sponge 126. Opposed transverse slits 136 then extend outwardly from the longitudinal slit 134. These slits may be small but, as shown generally, particularly in FIG. 5 expand when the sponge is in its useful position. The arrangement is such that the support member 102 may be located in the sponge 126 and the locking member 112 then pressed into the support member 102 with a frictional fit to compress the sponge 126 between the exterior of the locking member 112 and the interior of the support member 102 to locate the sponge 126. The arrangement is shown in FIG. 5. However support member 102 and locking member 112 may also be located, in addition to friction, by glue, screws or press snaps.

The use of frictional attachment has the advantage that the sponge may be easily removed.

As in the previous embodiments the sponge 126 may have convex front and rear surfaces. Again a handle that comprises a plurality of lengths, adapted to attach to each other is preferred but the handle can be in one piece. The handle should have a soft sleeve to prevent the handle damaging the surface against which it is knocked.

Figure 6:
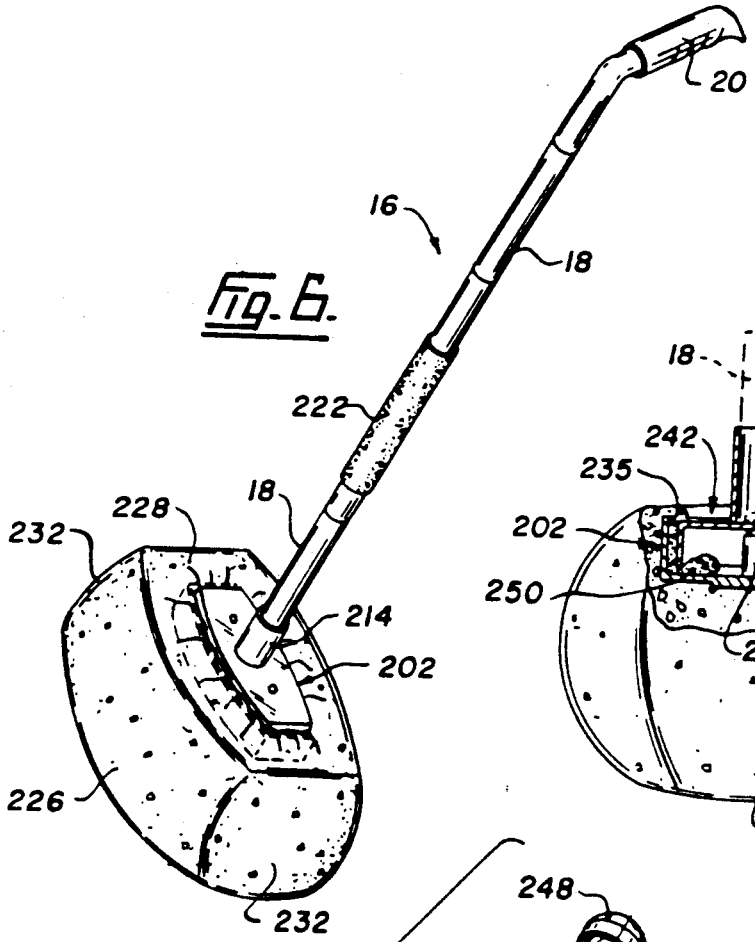
FIG. 6 is a general view of a mop according to a further embodiment of the present invention.
Figure 7:
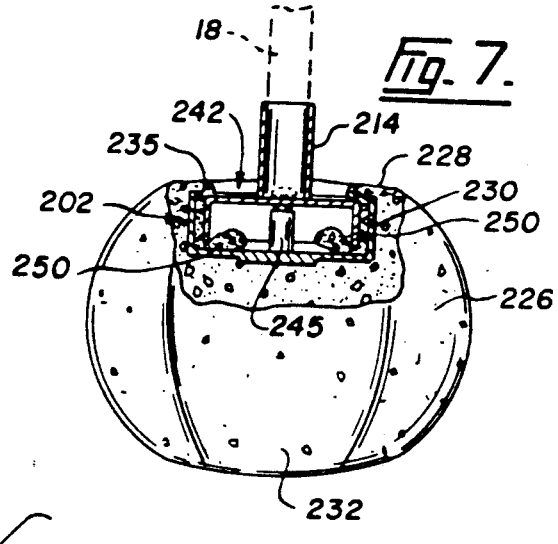
FIG. 7 is a side elevation, partially in section, of the mop of FIG. 6.
Figure 8:
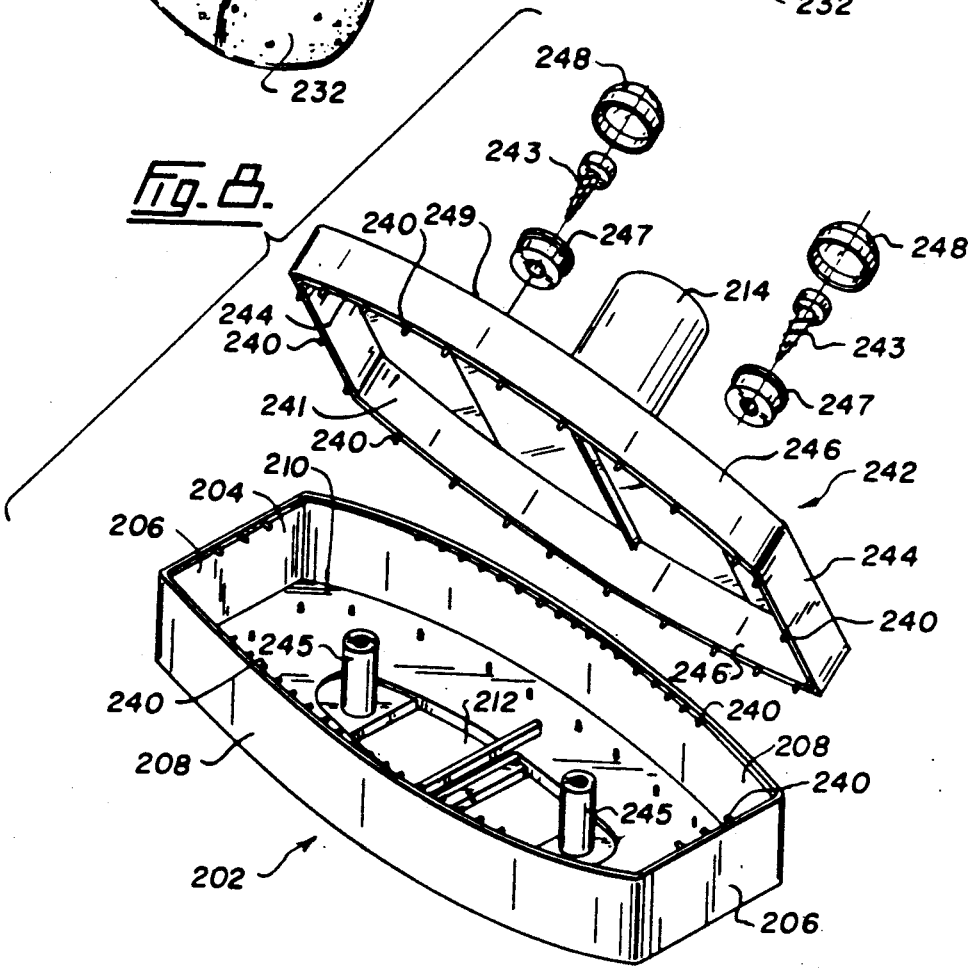
FIG. 8 is a detailed view of the support and clamping members of the mop.

FIGS. 6 to 8 show a mop comprising a support member 202 that is a hollow body, open at its top 204 and having ends 206, sides 208 and a base 210. There are openings 212 in the base 210 of the support member 202. As best shown in FIG. 8, the perimeter of the open top 204 is formed with a plurality of short, spaced gripping teeth 240 extending inwardly into the interior of the hollow body of support member 202.

FIG. 8 also shows a clamping member 242 which comprises a hollow body having an open base 241 with ends 244, sides 246 and top 249. Clamping member 242 is shaped to fit within the interior of support member 202 with a predetermined clearance 235 at the periphery. Clamping member 242 is also formed with a plurality of short gripping teeth 240 about its open base 241. These teeth are spaced to fit between an identical set of teeth 40 formed on the base 210 of support member 202. Clamping member 242 is removably attached within the interior of support member 202 by screw fasteners 243 that extend through holes in the clamping member 242 for threaded engagement in housings 245 that extend upwardly from the base of the support member. Preferably, screw fasteners 243 are sealed using sealing members 247. In addition, caps 248 can be attached over fasteners 243 in order to further seal the fasteners.

A socket 14 extends from clamping member 242 to receive a handle 16 as in the previous embodiments.

The mop is constructed simply by placing the sponge 226 over the support member 202; relatively slight distortion of the sponge is sufficient to obtain the necessary position. As best shown, in FIG. 7, the edges 250 of recess 230 are folded into the interior of support member 202, and clamping member 242 is inserted over top of these edges. By tightening screw fasteners 243 into housings 245, the clamping member 242 acts to compress and clamp the edges of the sponge within the interior of the support member. The plurality of gripping teeth 240 also act to engage the sponge material to prevent slippage of the sponge. FIG. 6 shows the mop in its assembled state. The lengths 18 of handle 16 are used depending on the height of the person using the sponge. The mop is then ready to use.

Typically a liquid cake, or powder detergent may be placed in the interior of support member 202 and allowed to percolate into the sponge 26 through openings 212 in the base. The sponge 226 may then be moved around the tub for cleaning. Because of its shape and because of the large volume of the sponge 226 the sponge can easily conform to all the shapes of a tub. Furthermore, because of the handle the tub can be cleaned by one person standing at one place.

The mops of the present invention are useful with conventional size tubs, large tubs or oval tubs. Hot tubs can also be cleaned using the mop of the present invention. The differences in dimensions can easily be accommodated simply by adding extra lengths 18 to the handle 16. Such lengths can be added either by providing a snap-on fit for the adjoining sections 18 of the handle or, of course, having screw threads at each end of each section.

The handles, support members and clamping members may be made of relatively rigid plastic. The handle may be of rigid plastic, aluminum, reinforced plastic or treated wood. The sponge is of conventional material, for example a polyurethane sponge can be used. The base of the sponges 26 126 and 226 should always be convex but the front and rear may be flat. The handle 16 can also be formed as a one piece unit of metal, aluminum, plastic, fibreglass or any mixes thereof, the handle 16 could also be made telescopic comprising 2 tubular lengths applied to one another through friction and held in place by plastic fittings or the like.

To clean the mop after use it is simply pressed against the tub and the water is expressed in a conventional manner. The sponge can be changed quickly and easily, if desired, by removing the clamping member and fitting the support member into a new sponge. Alternatively, handle 16 can be removed from socket 14 and the handle replaced into a socket of a completely new sponge mop head with clamping member 42 and support member 2 already in place.

I claim:

1. A mop comprising:

a support member comprising a hollow body, open at its top, and having ends, sides and a base;

a locking member comprising a hollow body having an open base and having ends, sides and a top, to allow the locking member to fit within the support member with a predetermined peripheral clearance between the two members;

a socket attached to the exterior of the top of the locking member to receive a handle;

a compressible, absorbent sponge comprising a body having a top surface and flat ends;

a longitudinal slit in the sponge extending substantially parallel to the sides of the locking member;

opposed transverse slits in the sponge extending outwardly from the longitudinal slit substantially parallel to the ends of the locking member, the longitudinal and transverse slits extending from the top surface into the sponge to define a plurality of adjacent sponge flaps separated by slits, the slits being arranged and the peripheral clearance being selected so that the sponge flaps between the slits are disposed in the peripheral clearance and frictionally held between the locking member and the support member when the locking member is disposed within the support member;

whereby the support member may be located in the sponge and the locking member pressed into the support member to compress the sponge between the exterior of the locking member and the interior of the support member to locate and hold the sponge.

2. A mop as claimed in claim 1 in which the sponge also has a convex front and rear surface.

3. A mop as claimed in claim 1 including a handle comprising a plurality of lengths, each adapted to attach to another length.

4. A mop as claimed in claim 1 having a soft sleeve on the handle to prevent the handle damaging the surface against which it is knocked.

5. A mop as claimed in claim 1 including a plurality of gripping teeth formed about the perimeter of said open top of said support member and about the perimeter of said open base of said locking member for frictionally engaging said sponge to prevent slippage.

6. A mop as claimed in claim 1 in which the base of said support member is formed with gripping teeth.

7. A mop as claimed in claim 1 including fastening means for securing said locking member to said support member.

8. A mop as claimed in claim 7 in which said fastening means comprises threaded screw fasteners extending through said locking member for engagement in housings formed in the base of said support member.

9. A mop as claimed in claim 8 having sealing members about said screw fasteners.

10. A mop as claimed in claim 1 in which there are openings in the base of the support member whereby a liquid cleaner, cake or powder can be placed in the support member to penetrate the sponge.

* * * * *